United States Patent [19]

Larizza et al.

[11] Patent Number: 4,671,301

[45] Date of Patent: Jun. 9, 1987

[54] TILTING ASHTRAY

[76] Inventors: Pietro Larizza, Via Guido Rossa, 54, Limbiate; Dino Falcone, Via Benassai, 3, Reggio Calabria, both of Italy

[21] Appl. No.: 663,646

[22] Filed: Oct. 22, 1984

[30] Foreign Application Priority Data

Oct. 25, 1983 [IT] Italy ..... 23361/83[U]

[51] Int. Cl.[4] ..... A24F 19/00; A24F 19/06

[52] U.S. Cl. ..... 131/231; 131/240.1; 131/241; 131/242

[58] Field of Search ..... 131/231, 240.1, 241, 131/242

[56] References Cited

FOREIGN PATENT DOCUMENTS 0626108 12/1926 France ..... 131/231

*Primary Examiner*—V. Millin

*Attorney, Agent, or Firm*—Seidel, Gonda, Goldhammer & Abbott

[57] ABSTRACT

Tilting ashtray comprising a container for the collection of stubs and ash and a closure lid for the container, wherein the bearing base of container has a convex shape, while closure lid includes a plate adapted to close the top of the container and provided with an opening whereby under said opening an additional plate is located for temporary collection of stubs and ash before they are caused to fall into container by means of a tilting thereof.

3 Claims, 3 Drawing Figures

TILTING ASHTRAY

BACKGROUND OF THE INVENTION

The present invention relates to a tilting ashtray.

A large variety of types or models of ashtrays are known, all clearly amenable to a structure of receptacle or container adapted to receive ash and stubs. From the simplest models, including substantially only the receptable or container, more sophisticated models have been developed where the top of the container is provided with a closure lid in turn structured in such a way that it has a platform where the ash and stubs are temporarily collected, said platform having suitable means to allow the subsequent fall of the collected materials into the container therebelow.

The ashtray of the second type presently on the market are of several kinds and their differentiating features are the particular design of the ash-and-stub-collecting platform and of the means allowing them to be discharged in the underlying container. This invention concerns an ashtray of the latter type of ashtrays.

SUMMARY OF THE INVENTION

The subject ashtray is adapted to overcome the drawbacks of conventional ashtrays including substantially their complicated construction and the difficult actuation of the means provided to allow ash and stubs to fall into the container.

The object of this invention is therefore to provide an ashtray of the aforementioned type, that is extremely simple in construction and therefore inexpensive, and moreover is comfortable and easy to use, while providing the same operational features of conventional ashtrays.

BRIEF DESCRIPTION OF THE DRAWINGS

The features and advantages of the ashtray according to this invention will become apparent from the following detailed description of an embodiment thereof, having no meaning of limitation, and made with reference to the attached drawings in which.

DESCRIPTION OF THE PREFERRED EMBODIMENT

Figure 1:
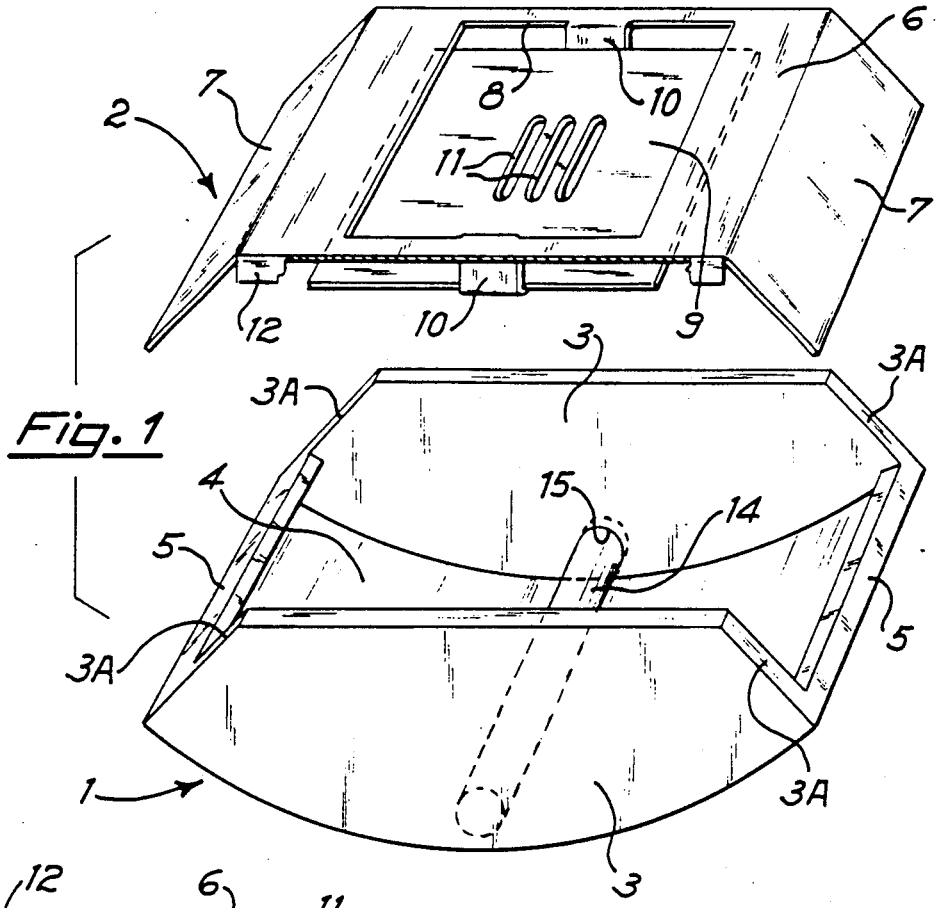
FIG. 1 is an exploded perspective view of the ashtray of this invention.

The subject ashtray essentially comprises a receptacle or container provided to collect ash and stubs, generally indicated with 1, and a top closure lid, generally indicated with 2.

The container for collecting ash and stubs is comprised of two flat sidewalls 3 parallel to each other and having side edges 3A sloping with respect to the upper edge of side walls 3 and forming an obtuse angle therewith. Container 1 is also provided with a bottom wall 4 that, according to one of the features of the ashtray of the present invention, has an outwardly convex shape. In particular the bottom wall 4 consists of a sector of cylindrical wall having its generating lines normal to the side walls 3. In this way the bearing surface where the ashtray will lay on a table or similar is substantially cylindrical in shape, and therefore it can tilt around a substantially horizontal axis, when the ashtray is actuated by the user.

Finally at either ends of bottom wall 4 of container 1 a projecting edge or rim 5 is provided, extending in the same direction as the sloping edges 3A of side walls 3, and flush therewith, said rim together with lid 2 providing closure means for the ashtray.

Closure lid 2 is in two pieces and more particularly a first part comprising a plate 6 preferably but not necessarily metal, having at either end thereof two flaps or extensions 7 forming with the plane of plate 6 the same angle included between side edges 3A of side walls 3 and the upper edges of the latter. In this way, as it is apparent in particular from FIG. 2, when lid 2 is applied to container 1, said flaps 7 close the sides of the ashtray.

Centrally of plate 6 an opening 8 is provided of substantially square shape, and underneath said opening there is located an additional plate 9 adapted to provide a plane on top of which ash and stubs are temporarily collected before being discharged into container 1.

Figure 2:
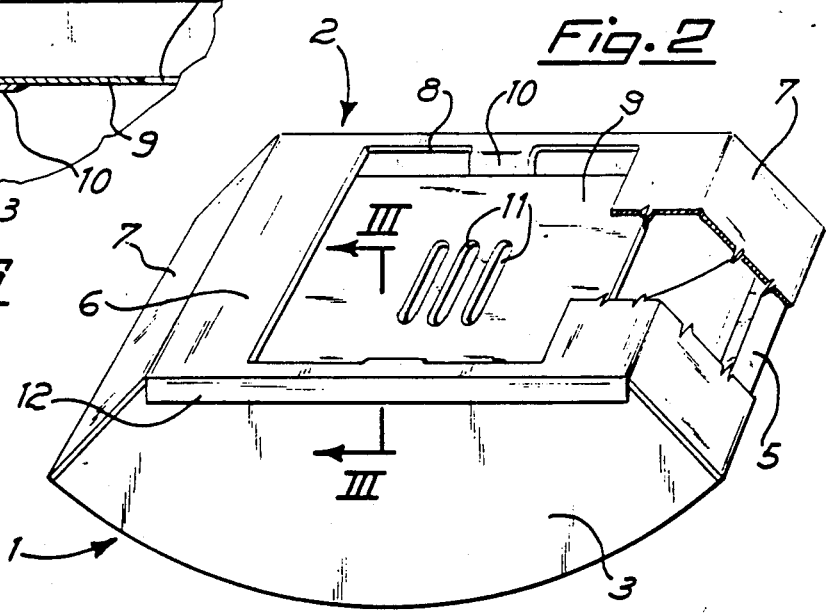
FIG. 2 is a perspective view of the ashtray in an operative condition.

As it can be seen in particular from FIG. 1 and 2, said additional plate 9 has a slightly longer length than opening 8 since its sides parallel to container side walls 3 are longer than the corresponding sides of opening 8.

Said additional plate 9 is connected to upper plate 6 by means of two substantially L-shaped extensions 10 of the latter, bent downward and located substantially in a central position on side edges of opening 8.

Plate 9 is affixed to the horizontal legs of extensions 10 and, since lid 2 is Preferably metal, said fastening will be performed by welding. In addition said plate has slits 11 to allow the ash that collect on plate 9 in the process of extinguishing the cigarette, to fall directly into container 1.

The layout of slits 11, their shape, their number as well as their size, as shown in he attached drawings, are not meant to be limiting.

Figure 3:
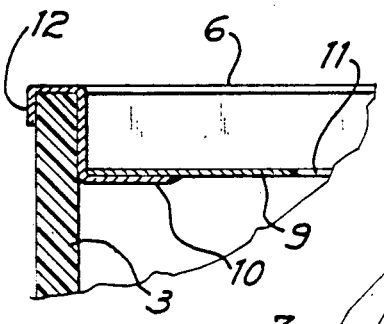
FIG. 3 is a sectional view of the ashtray along section line III—III of FIG. 2.

Lid 2 is finally provided, on the sides thereof bearing on the upper edges of side walls 3, with a downwardly bent rim 12 forming a 90° angle relative to the plane of plate 6, and extending for the whole length thereof. Said bent rim 12 provides both a secure connection between lid 2 and container 1, as well as the possibility to unfasten lid 2 from container 1 when the latter has to be emptied. Referring now to FIG. 3 it should be noted in fact that the vertical legs of extension 10 and rims 12 are located on opposite sides of side walls 3, therefore securing lid 2 over container 1 and allowing for an easy unfastening of said lid by way of the two rims 12.

From the above description the advantages provided by usage of the ashtray according to this invention are apparent, said ashtray in addition to being simple to build and therefore inexpensive, is easy to use both concerning the collection of ash and stubs into container 1, as well as the emptying thereof.

Concerning in particular the first aspect mentioned above, i.e. ash and stubs collection into container 1, the shape of the support base of the latter is extremely advantageous. In fact, when the user has collected on plate 9 the stubs and ash not fallen through slits 11, to cause them to fall into container 1 it will just be enough for him to apply pressure to one end of plate 6 and this will result in a tilting of the ashtray, which in turn will cause plate 9 to lean to an angle with a consequent fall of the stubs into container 1 and clearing of plate 9. All the sophisticated devices of the conventional ashtrays are therefore eliminated.

Finally the ashtray according to this invention is provided with a small metal bar 14, transversely arranged with respect to said ashtray, the ends of said bar being inserted in corresponding recesses 15 provided internally of side walls 3 of container 1. Metal bar 14 has a dampening effect on the oscillations imposed upon the ashtray, so that they are neither too wide in amplitude not too extended in time.

Even though this is not shown in the attached drawings, the ashtray according to this invention is provided, on the outer surface of bottom wall 4, i.e. the surface that comes in contact with the support surface of the ashtray, with a sound-dampening and antisliding lining, made for instance of felt, rubber or a similar material. Said lining can be applied either partially or on the whole surface mentioned above.

Finally it should be understood that variations and modifications can be made to the ashtray according to this invention, without exceeding the scope of protection of the same invention.

For example, the support base of the ashtray may have a convex shape different from that shown, for instance emispheric, or in any other way outwardly convex.

Furthermore, the flaps or extensions 7 of upper plate 6 may be omitted and in such case container 1 will be provided with closure walls adapted to replace said extensions.

Extensions 10 may have the same width as the corresponding sides of opening 8 in plate 6.

Finally it is possible to use a very large variety of materials in the manufacture of the subject ashtray, from platic materials to metal.

What we claim is:

1. An ashtray for the collection of stubs and ash comprising a container and a closure lid for the container; said container having a convex bearing base; said closure lid including an upper plate on top of the container, said upper plate provided with an opening; and a lower plate under the opening in and supported by downwardly bent extensions of the upper plate for temporary collection of stubs and ash before they are caused to fall into the container by means of tilting the container.

2. An ashtray for the collection of stubs and ash comprising a container and a closure lid for the container; said container having a convex bearing base; said closure lid including an upper plate on top of the container provided with an opening and having edge portions which comprise downwardly bent flaps, said flaps adapted to engage with corresponding slanting side rims of the side walls of the container and with a projecting rim at the end of the bottom wall of the container, said projecting rim having a height much lower than the side edges of the side walls of the container; and a lower plate located under the opening in said upper plate for temporary collection of stubs and ash before they are caused to fall into the container by means of tilting the container.

3. An ashtray for the collection of stubs and ash comprising a container and a closure lid for the container, said container having a convex bearing base, said closure lid including an upper plate on top of the container, said upper plate provided with an opening, a lower plate located under the opening in said upper plate for temporary collection of the stubs and ash before they are caused to fall into the container by means of tilting the container, and a metal element fastened to the inside of the container in a substantially central region of the container to reduce the amplitude and duration of oscillations of a container.

* * * * *